United States Patent [19]

Broadbelt et al.

[11] Patent Number: 4,774,985

[45] Date of Patent: Oct. 4, 1988

[54] APPARATUS FOR FILLING AUTOMOTIVE MUFFLER WITH GLASS FIBERS

[75] Inventors: Keith Broadbelt; David Cattermole, both of Rochdale; Ralph Huggett, Preston, all of England

[73] Assignee: TBA Industrial Products Ltd., Manchester, England

[21] Appl. No.: 90,349

[22] Filed: Aug. 28, 1987

Related U.S. Application Data

[63] Continuation-in-part of Ser. No. 930,992, Nov. 14, 1986, abandoned, which is a continuation of Ser. No. 671,779, Nov. 15, 1984, abandoned.

[30] Foreign Application Priority Data

| | | | |
|---|---|---|---|
| Nov. 18, 1983 | [GB] | United Kingdom | 8330799 |
| Nov. 18, 1983 | [GB] | United Kingdom | 8330800 |
| Nov. 18, 1983 | [GB] | United Kingdom | 8330801 |

[51] Int. Cl.[4] ..... F01N 3/00; B01D 46/10; F02C 7/045

[52] U.S. Cl. ..... 141/12; 141/5; 141/103; 141/73; 141/129; 141/250; 29/157 R

[58] Field of Search ..... 406/194; 29/530, 157 R; 55/276; 141/5, 6–12, 1, 98, 99, 100–105, 37, 67, 68, 285, 250, 253, 263, 270, 72–81, 392, 129, 325, 326, 327, 368, 234–248

[56] References Cited

U.S. PATENT DOCUMENTS

| | | | |
|---|---|---|---|
| 1,676,734 | 7/1928 | Hopkins | 141/103 X |
| 2,501,652 | 3/1950 | Barrickman | 141/113 X |
| 2,777,481 | 1/1957 | Atkinson et al. | 141/382 X |
| 2,821,346 | 1/1958 | Fisher | 406/194 X |
| 2,924,868 | 2/1960 | Dyer | 406/194 X |
| 2,982,082 | 5/1961 | Pool | 406/194 X |
| 3,062,246 | 11/1962 | Koehler | 141/234 X |
| 3,485,593 | 12/1969 | Lenane et al. | 55/276 |
| 3,601,955 | 8/1971 | Ferri | 141/67 X |
| 3,613,830 | 10/1971 | Hubbell, III | 29/157 R |
| 3,671,168 | 6/1972 | Nussbaum | 141/100 X |
| 3,955,643 | 5/1976 | Clark | 29/157 R X |
| 4,146,065 | 3/1979 | Borstelmann | 141/5 |
| 4,486,932 | 12/1984 | Hall et al. | 29/157 R |
| 4,565,227 | 1/1986 | Shebuski | 141/1 |
| 4,569,471 | 2/1986 | Ingemansson et al. | 141/7 |

FOREIGN PATENT DOCUMENTS

| | | | |
|---|---|---|---|
| 698172 | 11/1964 | Canada | 141/67 |
| 0091413 | 10/1983 | European Pat. Off. | 141/5 |
| 893020 | 4/1962 | United Kingdom | 141/71 |

*Primary Examiner*—Henry J. Recla
*Assistant Examiner*—Ernest G. Cusick
*Attorney, Agent, or Firm*—Nixon & Vanderhye

[57] ABSTRACT

A process and apparatus for filling a generally tubular autmotive silencer casing with glass fibres are characterized by the feature of filling the casing from both ends simultaneously, preferably with the aid of spacer elements temporarily located on the ends of the casing during the filling step, any overflow of fibres into these elements being subsequently pushed into the casing to give a uniform density fill prior to installing end caps. The process/apparatus preferably also features bulking of the fibres by passing them through a specific jet configuration more than one of which may be used at each filling station.

12 Claims, 9 Drawing Sheets

APPARATUS FOR FILLING AUTOMOTIVE MUFFLER WITH GLASS FIBERS

CROSS-REFERENCE TO RELATED APPLICATIONS

This is a continuation-in-part of Ser. No. 930,992, now abandoned, filed Nov. 14, 1986 which was a Continuation of Ser. No. 671,779 filed Nov. 15, 1984, both now abandoned.

BACKGROUND OF THE INVENTION

Glass and/or mineral fibers are widely used for thermal and/or acoustic insulation. In the case of glass fibers it is common practice to chop continuous filament material into short lengths (staple fibers), thereafter forming a mat from the staple fibers produced, or simply packing the staple fibers into a supporting member. Thus staple fibers are packed into automotive muffler or silencer casings, into cavity walls, or are incorporated into sandwich panels for use in building construction.

The mechanical chopping of glass filaments into staple fibers requires high speed rotating machinery; it may also expose workers to the physiological effects of staple fibers which are usually harsh, spiky and abrasive. In the case of automotive muffler or silencer casings the handling of staple glass fibers is a particular problem. It is difficult to accurately meter loose fibers entrained in an airstream, which is the usual mode of fiber transfer, especially where only a limited time is available to fill each casing, as on an automated production line for silencers. In this specification and the claims that follow, silencers and mufflers are used interchangeably.

It is well known that a continuous glass fiber roving or sliver can be bulked by exposure to a highly turbulent airstream prior to deposition in a container as a fleece without breaking the filaments. It has been proposed in EP-A-0091413 that this process should be used to fill automotive silencer casings with bulked, continuous filament glass fibers, using suction applied through the casing to effect deposition of the appropriate quantity of glass fiber.

The process just described employs a conventional textile bulking or texturing jet as a means of exposing a continuous filament roving to the action of a highly turbulent airstream. It also uses a separate cutter device operable to sever the roving on completion of each silencer filling operation.

Common to known processes for filling silencer casings with glass fibers is the problem of achieving uniform bulk density of the filled material. As the casing fills up it is progressively more difficult for air to escape through the fibrous mass, even using suction and an/or an auxiliary airflow. Also, the material is both very bulky and very resilient, so it tends to spring back towards the outlet of the bulking jet. This progressively affects the quality of the bulking operation; it eventually slows down the rate of delivery from the jet, by virtue of progressively occluding the jet outlet. It also results in the last material supplied to a casing being of significantly lower bulk density than the first material supplied, to the point where it is even impossible to transfer the filled casing to further processing stages such as the installation end caps, because the filled material tends to overflow out of the end of the casing. EP-A-0091413 discloses a process for filling a silencer casing, but only from one open end thereof. Such a process is effective for roughly half of the commonly used types of absorptive silencer. There are, however, other very commonly used types of absorptive silencer where the process just referred to is ineffective and/or inefficient. For example, there are 'straight-through' silencers, the automated production of which includes the step of fitting both end caps at once. For these, it is normal to use a glass fiber preform made in situ around a length of perforated exhaust gas duct to locate the latter duct inside the casing prior to affixing the end caps. Preform manufacture is an essential, extra step in this particular process. There are also silencers which have two separate fiber-filled absorptive regions either side of a reactive element comprising baffles in an intermediate fiber free volume. The absorptive regions may be of different shapes and/or sizes, but once again it is normal to fit both end closures at the same time.

It is an object of the present invention to provide an improved process and apparatus for filling a silencer casing with glass fibers.

SUMMARY OF THE INVENTION

According to the present invention a process for filling a silencer casing with glass fibers is characterised by the steps of presenting oppositely directed open ends of the casing substantially simultaneously to glass fiber filling stations and filling the casing from both ends thereof. Subsequently closures are affixed to these ends, preferably simultaneously.

According to a further aspect of the invention, apparatus for filling a silencer casing includes two glass fiber feeding stations and means for presenting oppositely directed open ends of the casing to said stations substantially simultaneously. Preferably each feeding station comprises at least one bulking jet operable to bulk a continuous filament glass fiber roving prior to deposition in the casing by the jet as bulked continuous filaments.

The invention further includes a silencer production line equipped with the apparatus of this invention, or modified to carry out the process of this invention.

BRIEF DESCRIPTION OF THE DRAWINGS

In order that the invention be better understood aspects of it will now be described by way of example with reference to the accompanying drawings in which.

DESCRIPTION OF THE PREFERRED EMBODIMENT

Figure 1:
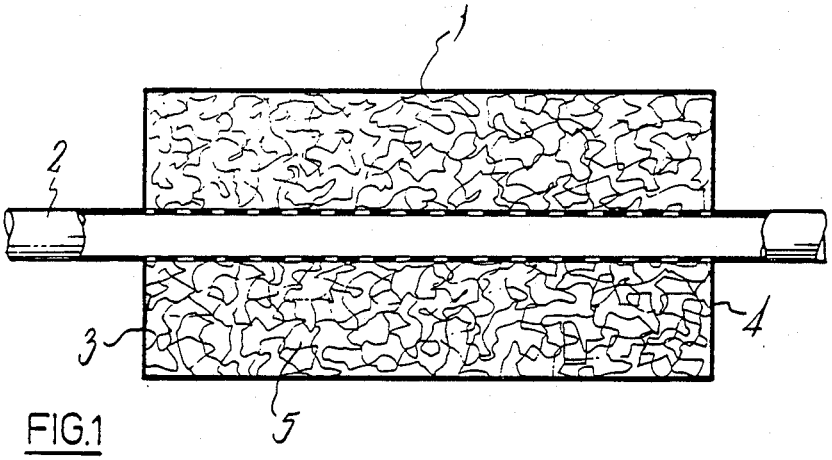
FIG. 1 is a diagrammatic cross-sectional side view of a 'straight-through' silencer.

Preferably the process includes the steps of feeding a continuous filament glass fiber roving to each filling station and converting the roving to relatively bulky form prior to filling the casing with it. The roving may also be cut into staple fibers prior to bulking, but preferably it remains in continuous filament form throughout the process.

The roving is preferably converted to relatively bulky form by the step of subjecting it to an air treatment in the filling station a known bulking jet. More preferably, however, the air treatment is carried out by causing the roving to pass through a bulking jet having novel constructional features, which will be discussed in detail later in this specification.

The process of the invention is preferably further characterised by the step of temporarily locating one end of a tubular spacer element on each open end of the casing prior to the filling step. Advantageously the filling step is in this particular instance carried out until an overflow or excess of fibers has been deposited in the spacer element and this is then followed by the further step of pushing the overflow from the spacer elements into the casing prior to removing the spacer element and subsequently affixing the closures to the ends of the casing.

The use of a spacer element effectively increases the volume to be filled, so that not only is any overflow completely contained within the spacer element, but by pushing the overflow out of the spacer element into the casing, the latter can be filled to a substantially uniform density. Metering the feed of glass fiber by length is relatively easy and accurate, so that the actual quantity (mass) of bulked fibers (stable or continuous filament) can be fully controlled. It remains only to monitor the quality of bulking and the pressure applied to push the overflow into the casing.

Where filling is to be accomplished around an otherwise unsupported perforated tube, as in the case of a straight-through silencer, the process of the invention should be further modified by addition of the steps of locating and/or temporarily retaining the tube axially and radially with respect to the casing at least until there is sufficient in-filled material to do so.

Each filling station may have more than one bulking jet together with individual roving supply means for each such number and disposition of jet, the jets being arranged to reflect the cross-sectional shape and volume of the casing to be filled.

According to a particularly preferred feature of the present invention, a bulking jet comprises a roving entry passageway, an airstream entry passageway and means for distributing the airstream evenly around the roving as an essentially annular sheath in the region of contact there-between, together with a common outlet passageway for the airstream and roving, characterized in that the flow restriction due to that area of the annulus defining said sheath immediately prior to said region of contact is significantly less than that due to the common outlet passageway. It will be understood that the latter restriction is referred to the outlet passageway in use, that is in the present of both air and glass fiber roving.

The effect is that the throughput of air is no longer restricted by the means for forming the airstream into an annular sheath around the roving. Instead, the common outlet passageway now becomes a very critical element.

It has been found that in the special context of bulking continuous filament glass fiber rovings is an automated process for filling automotive silencer casings, the length to diameter ratio of the preferably cylindrical, parallel sided common outlet passageway should be in the range 5 to 10, with a ratio of 8 being especially preferred. With typical roving throughout speeds of at least 500 meters/minute being required to achieve high speed filling of silencer casings on a production line basis, the construction of the bulking jet has been found to have very significant effect on the efficiency of the process, to the extent that conventional textile bulking-/texturing jets are unsatisfactory by comparison with a jet according to this invention.

Because the air throughout is only limited by the outlet passageway, very considerable forces are applied to the roving in the latter. This results not only in excellent bulking, but can also be used to eliminate the need for any external mechanical cutting device for the roving. It has been found that the forces exerted on the roving in the outlet passageway are in fact sufficient to break the roving if the supply is halted.

To eliminate any risk of roving being blown backwards out of the roving entry passageway it may be desirable to include some form of roving clamp operable to hold the roving, for example against a thread guide at the point of roving entry after breaking in the jet.

Conventional bulking jets normally have an outlet passageway which includes a venturi throat, immediately followed by an outwardly flared region in which the bulk is developed progressively. By contrast, the jet of this invention preferably not only has a parallel sided outlet passage but also the latter terminates abruptly to give sharp, almost explosive expansion of the air/roving mixture emerging from it. Because of the unusually high forces developed on the roving in the outlet passageway itself, it is necessary to minimize air leakage back along the roving entry passageway. However, it is also highly desirable that the latter should accept not just the roving but also a splice therein, since it is advantageous to be able to join roving packages end-to-end to give essentially continuous running. The diameter of such a splice will usually be at least twice the diameter of the roving itself, so the roving entry passageway must be considerably larger than the roving alone.

It has been found that these conflicting requirements of low leakage and free passage of a splice can be met by using an entry passageway having a length to diameter ratio in the range 10 to 20, with a ratio of 16 being particularly preferred when operating with rovings of linear density 2000 to 5000 tex. Single or multiple rovings may be used to obtain a desired roving density at the jet.

Common to silencer filling processes using the jets of this invention is the need to minimize the risk of loops or snarls developing in the (or each) roving being fed to the jet. This problem is made very much worse by the fact that silencer filling is a batchwise process resulting in rapid stop-start operation. In practical terms, the roving feed has to be stopped from and then re-started a high linear speed, typically over 500 meters/minute. It has been found that this can be accomplished by eliminating conventional tension control devices, yarn accumulators and the like. Instead, a capstan or godet wheel driven through a clutch/brake unit is used, the clutch/-brake serving to give a fully controlled rate of deceleration from and acceleration to the desired speed. This enables a continuously running drive means to be employed; it minimizes the mass of hardware to be stopped and started. It is particularly preferred to use an electrically or electronically controlled clutch/brake unit, so that the start-stop characteristics can be adjusted to minimize roving tension changes to the point where they are not a significant factor.

While the jet of this invention has especial utility in the manufacture of glass fiber filled silencer casings per se, it will be appreciated that it is equally applicable to a process for making shaped glass fiber preforms for subsequent insertion into silencer casings. Such preforms, rendered coherent by treatment with a very minor amount of binder, are necessary for silencer casings which do not readily lend themselves to automatic filling processes by reason of their shape and/or internal complexity.

Further aspects of the preferred jet construction will be described later, with reference to the drawings.

The apparatus preferably includes a tubular spacer element associated with each feeding station, together with means for presenting the spacer element to one open end of the casing so as to constitute an extension of the casing intermediate the casing and the feeding station itself. The apparatus then preferably includes presser means operable to push any overflow of glass fibers from the spacer element into the casing prior to transfer of the latter to apparatus operable to affix closures to the ends thereof.

The volume of the spacer element is not critical, but it is preferred that it should be of the order of up to 50% of that of the silencer casing itself. Advantageously the spacer element is of similar cross-sectional shape to the silencer casing to be filled. It is also advantageous that it should have a resilent facing on that region which is in use to be abutted against the silencer casing. This is useful to minimize both leakage and mechanical alignment problems. It will be appreciated that the actual cross-sectional shape of the spacer element and/or silencer casing is not critical; the invention can cope equally well with the oval, elliptical or circular sections encountered in the automotive industry.

Where there is an otherwise unsupported perforated tube to be located within and relative to the casing, the apparatus preferably includes means for so doing at least until the tube is sufficiently supported by the infilled glass fibers. Magnets associated with each filling station are the preferred means of temporarily locating the tube to be supported by or to the filling station so that the air can escape down the tube and through the filling station without interfering with the filling process.

The filling stations may be carried by headstocks mounted on a common support rail arrangement so that they can be advanced, for example by pneumatic cylinders, towards one another, to meet the oppositely directed open ends of a silencer casing which is presented between them by a conveyor system. The headstocks themselves may be caused to traverse with the latter conveyor system during the filling operation and prior to return to their starting point where they move inwards to engage the next casing to be filled. Obviously the precise arrangement adopted will reflect the nature of the associated silencer production line itself, but the bulking jets and the spacer element/presser means are preferably those disclosed above.

In FIG. 1 a cylindrical casing 1 has a centrally-disposed perforated tube 2 extending between and through end closures 3 and 4. The volume surrounding the tube is filled with glass fiber 5. The tube is otherwise unsupported until the closures are seamed to it and to the casing, except by the glass fiber filling 5.

Figure 2:
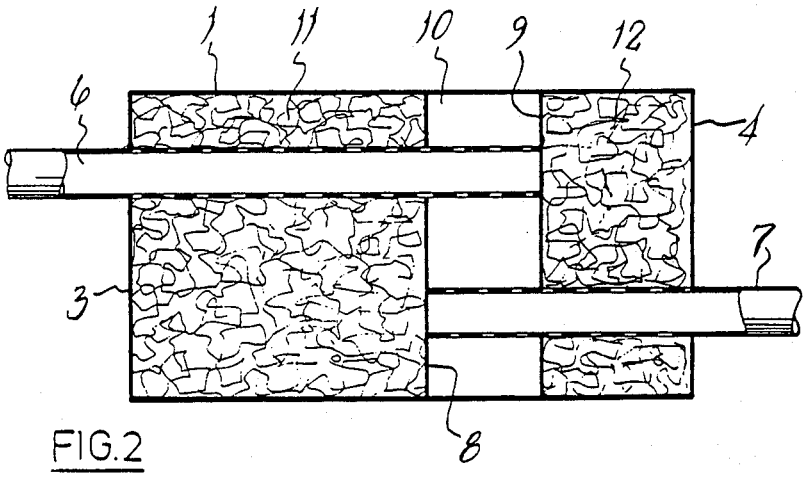
FIG. 2 is a diagrammatic cross-sectional side view of a double-ended silencer having a central fiber-free region.

In FIG. 2 the preferred same casing 1 and closures 3 and 4 are used, but the tube 2 is in two portions 6, 7 respectively, the ends of which overlap inside the casing to abut against internal partitions 9, 8 respectively. The partitions and casing together define a blind volume 10 between two separate volumes filled with fibers 11, 12.

Figure 3:
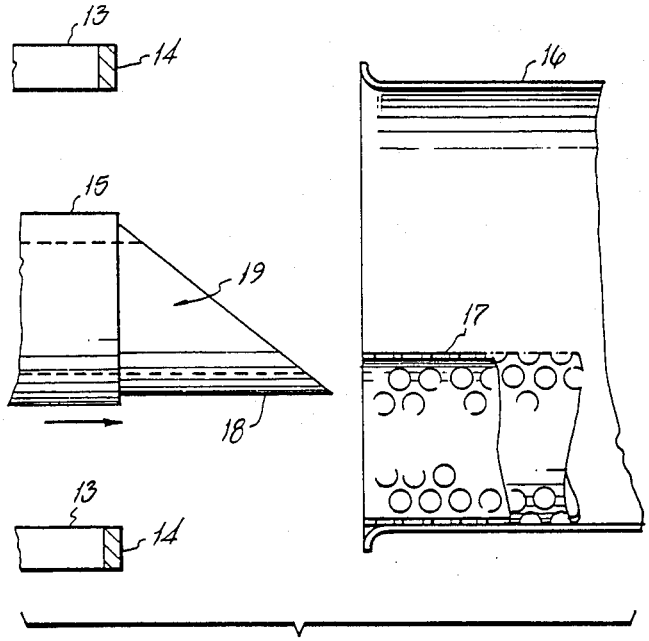
FIGS. 3 and 4 show progressive stages in the operation of part of a preferred apparatus for carrying out the process of the invention to make the silencer of FIG. 1, shown diagrammatically in cross-sectional view.
Figure 4:
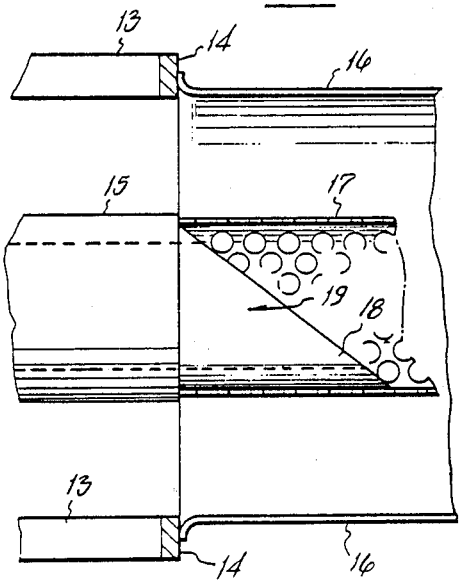
Figure 11A:
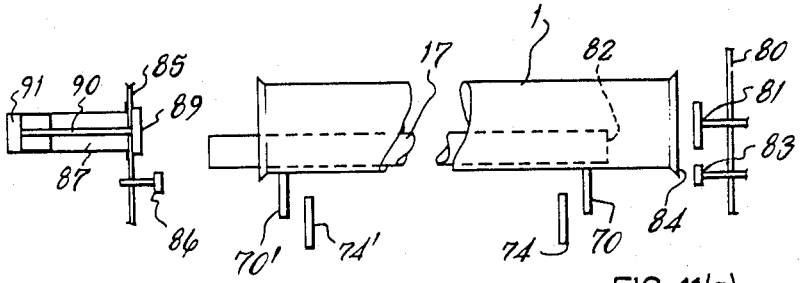
FIGS. 11(*a*) through 11(*c*) illustrate how the conveyor of FIGS. 10(*a*) through 10(*e*) interacts with related hardware to center silencer casings with respect to fiber filling stations, and FIGS. 12(*a*) through 12(*f*) illustrate how the conveyor system of FIG. 10 interacts with the glass fiber filling stations during filling.
Figure 11:
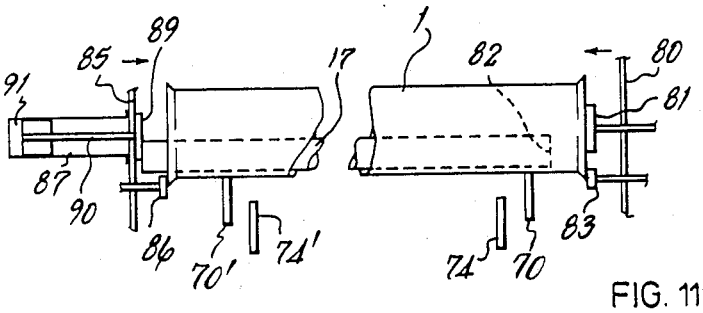
Figure 11C:
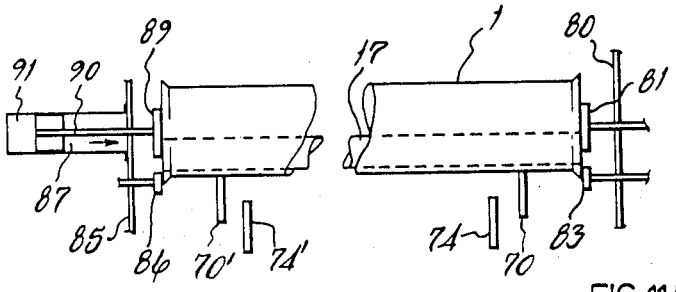
Figure 12A:
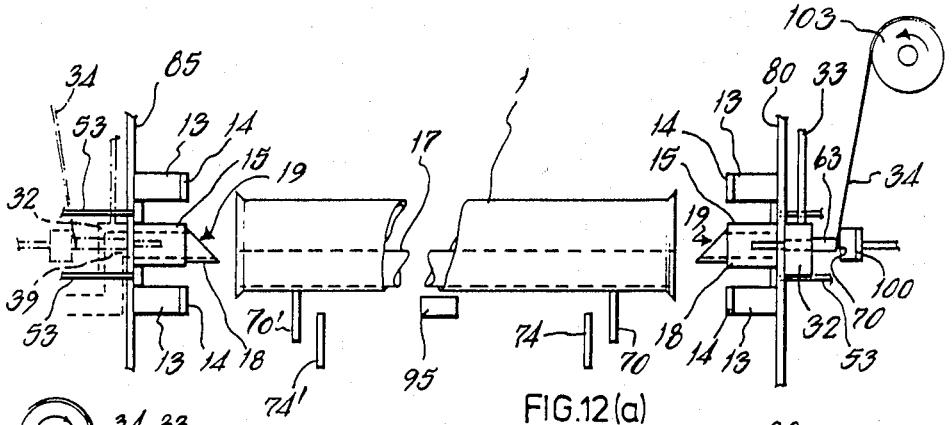
Figure 12B:
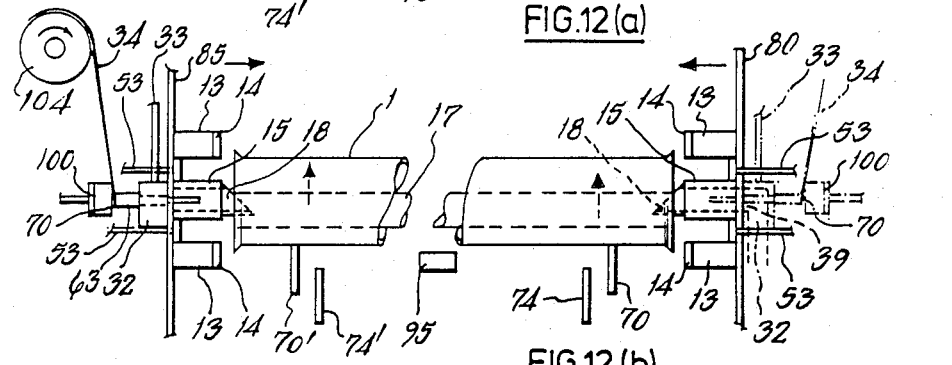
Figure 12C:
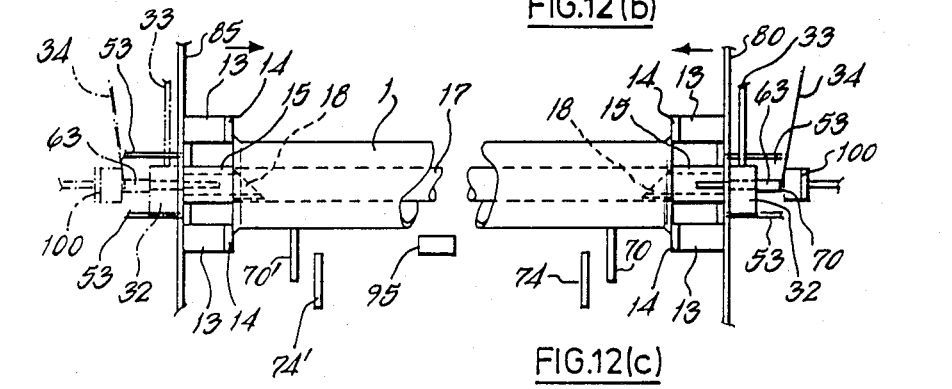
Figure 12D:
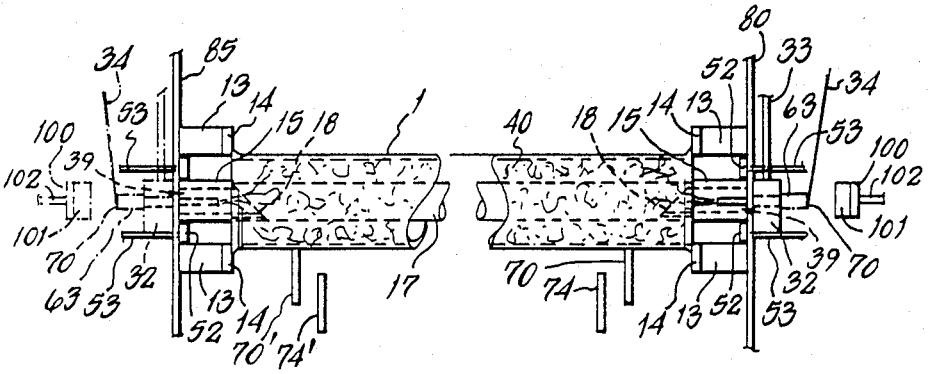
Figure 12E:
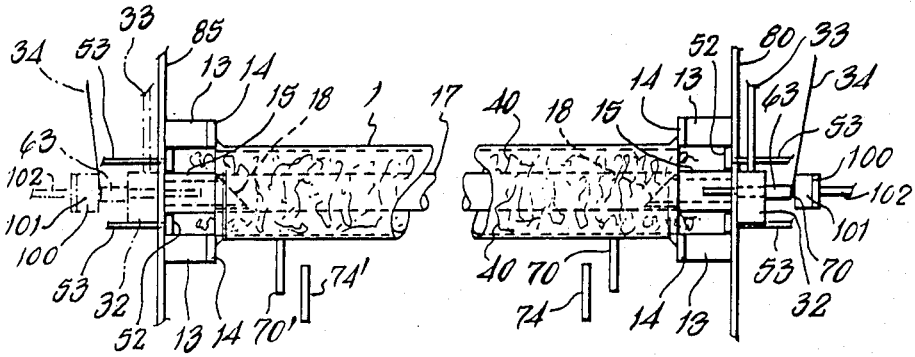
Figure 12F:
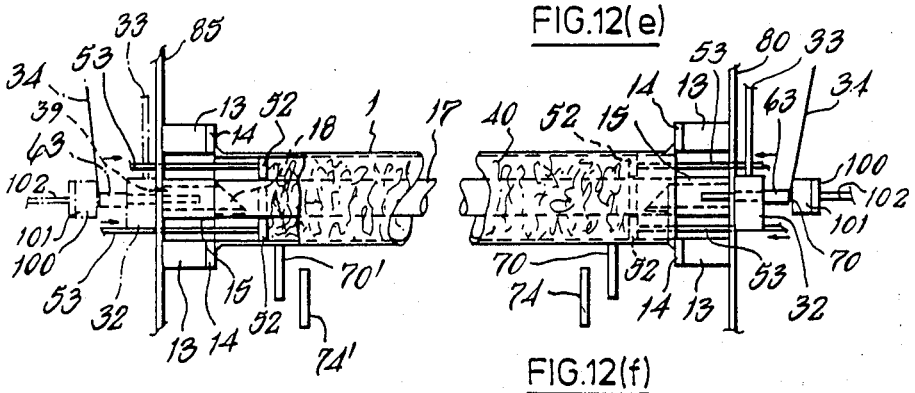

Referring now to FIGS. 3 and 4, one open end 16 of a silencer casing of FIG. 1 (the straight-through kind) is shown with a length of perforated tube 17 lying inside it. Advancing axially towards it is a filling station, parts only of which are shown, in the interests of simplicity. The casing is supported by a conveyor (not shown) having an associated magnet operable to hold the tube 17 relative to the casing until engaged by the filling station. The magnet is shown in FIGS. 12(*a*) through 12(*f*) and will be further described in relation to those figures. The filling station comprises a tubular spacer element 13 having resilient marginal portion 14 configured to locate and seal against the open end of the casing 16. A central support 15 advances with the spacer element until its shaped end 18 engages the tube 17 and lifts it away from the casing to a desired position relative to the center line of the casing, as shown in FIG. 4. The center 19 of the support 15 is hollow, to enable air to escape from the casing through the perforations in the tube 17. It will be appreciated that exactly the same arrangement applies at the opposite end of the casing as shown in FIGS. 11 and 12, so that filling can take place from both ends at once.

The length of the tube 17 will normally be greater than that of the casing and if so the length of the support 15 can be suitably changed to accommodate the projection of tube 17 beyond the end of the casing. Also not shown in this particular diagram are the presser means which are used to pack any overflow of glass fibers into the casing from inside the spacer element 13. After such a packing operation, the tube 17 will not normally require further support; the silencer casing, the tube and in-filled material can be forwarded for installation of the end closures in the usual way.

Figure 5:
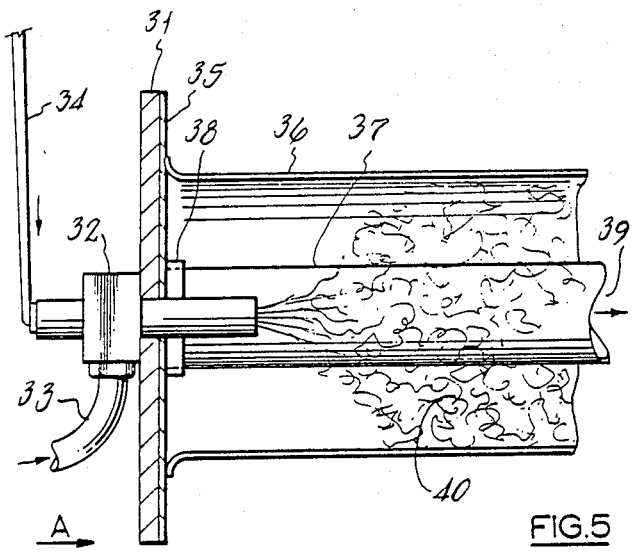
FIG. 5 shows the filling station of FIG. 4 in rather more detail.
Figure 6:
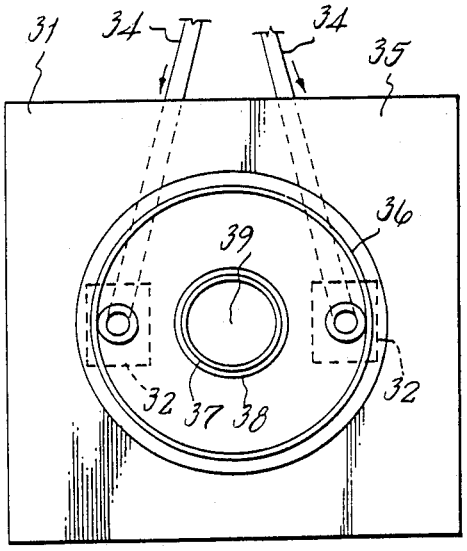
FIG. 6 shows the filling station of FIG. 5 from direction A of FIG. 5.

FIGS. 5 and 6 show a modified apparatus in which a backing plate 31 carries two bulking jets 32, each of which is supplied with continuous filament glass fiber roving 34 and high pressure air (typically at 450 $KN/M^2$) through pipe 33. The jets are preferably of the kind discussed below. The plate 31 has a resilient face 35 which abuts against the open end of a silencer casing 36. The casing contains a perforated exhaust gas duct 37, the free end of which is located by and against a locating stud 38 on the plate 31. This also serves to prevent glass fibers from being blown down into the duct, the opposite end 39 of which is open to allow the free escape of air from the casing during filling. The rovings 34 are metered from roving packages (not shown) by means of capstan or godet wheels 110 (shown only in FIGS. 12(*a*) through 12(*f*) and operated in the manner discussed earlier.

The operation of the station just described results in rapid filling of the casing with bulked glas fibers 40, at least until the bulk density approaches about 50 kg/m$^3$, or roughly half of a typical target bulk density in the range 80 to 100 kg/m$^3$. The quality of the bulking process then falls off, to the point where free passage of material into the casing becomes severely impaired and eventually stops. This gives unstable running conditions for the apparatus/process and results in variable bulk density, together with some overflow of material from the casing on transfer to the next production step, which is the installation of an end cap for the casing.

Figure 7:
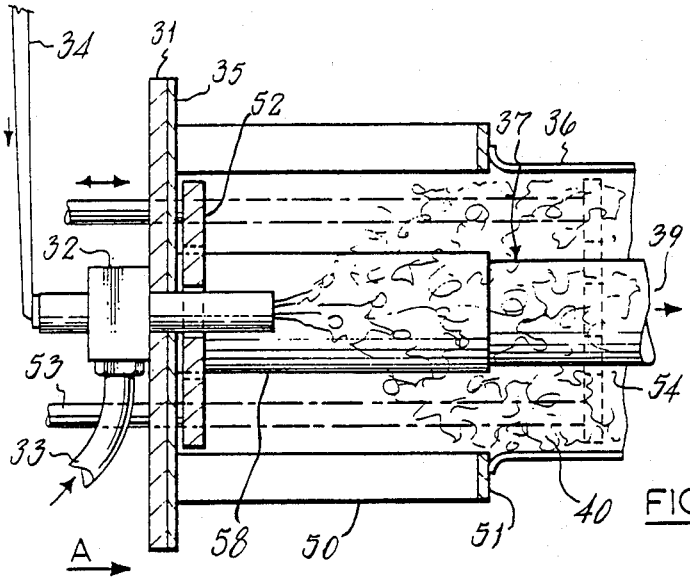
FIG. 7 shows a modified version of FIG. 5 in rather more detail.
Figure 8:
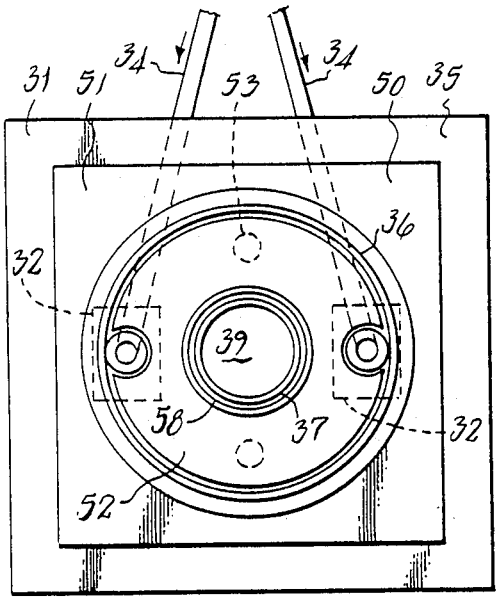
FIG. 8 shows it as seen from direction A in FIG. 7.

FIGS. 7 and 8 show the apparatus of FIGS. 5 and 6 further modified in accordance with a preferred feature of the invention. Thus a spacer element 50 having a resilient, silencer casing—contacting margin 51 is interposed between the casing 36 and the backplate 31. A corresponding extension 58 of the original stud 38 is provided to locate and close the perforated duct 37. A press plate 52 is included together with rods 53 operable to displace the plate as indicated by dashed lines towards and into the mouth of the casing (54). The press plate is configured to slide around the stud 58 and incorporates cut-outs to clear the jet nozzles.

Operation is exactly as before, except that for a given mass of glass fiber there is now the added volume of the spacer element available to be filled. By making this volume approximately 50% of the volume of the silencer casing, the problems of the previous apparatus/-process discussed are eliminated. There will however be some bulked material overflow into the spacer element itself. Operation of the press plate to transfer/-compact this overflow material well into the silencer casing completes the filling process and the casing can be forwarded for installation of its end cap.

Figure 9:
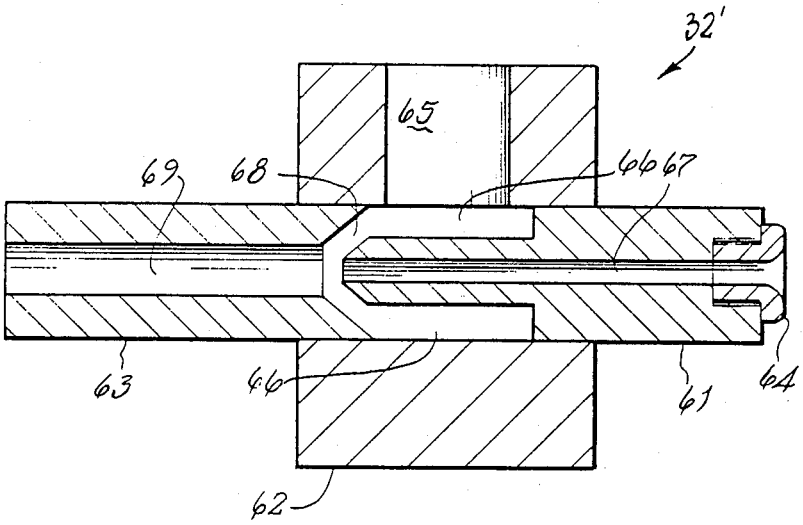
FIG. 9 illustrates the internal construction of a particularly preferred form of bulking jet for use at any of the filling stations shown, or at any of the filling stations shown later in FIGS. 12(*a*) through 12(*f*).
Figure 10A:
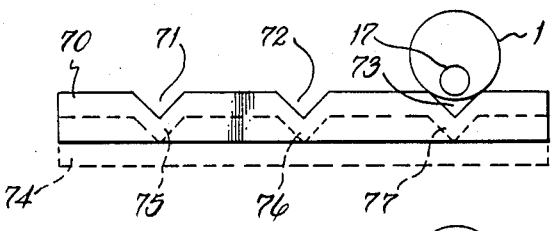
FIGS. 10(*a*) through 10(*e*) illustrate the action of a walking beam conveyor as used to move silencer casings through various stages of filling with glass fibers.
Figure 10B:
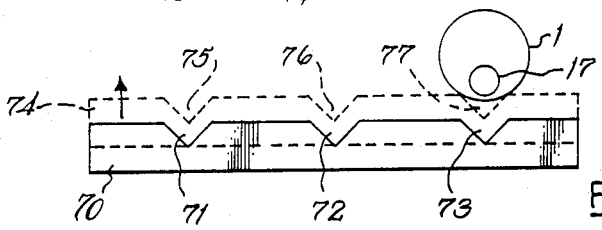
Figure 10C:
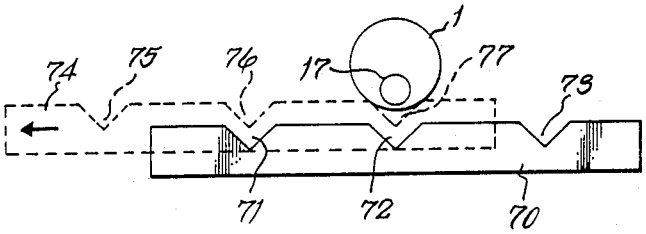
Figure 10D:
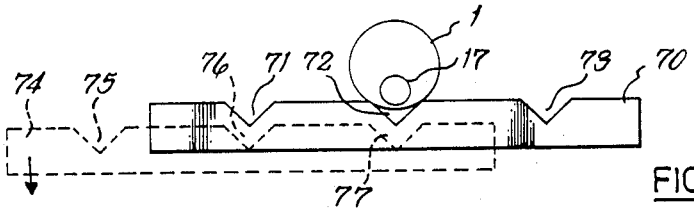
Figure 10E:
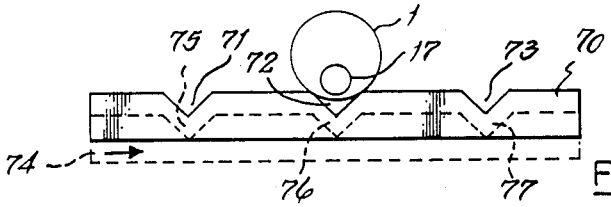

To further illustrate particularly preferred features of the invention, FIG. 9 shows a diagrammatic cross-sectional side view (on an enlarged scale) of a bulking jet 32' of the type generally as shown at 32 in FIGS. 5 through 8 in accordance with the invention.

The jet comprises a body 62 provided with airstream entry passage 65, a needle 61 in which there is a thread guide 64 opening into a roving entry passage 67, together with an outlet section 63 provided with an outlet passageway 69 terminating abruptly in a flat surface. The needle 61 terminates in an annular space 66 defined inside the body 62. The open end of the needle in that space and the opposed entrance to the outlet passageway 69 together define an annular gap 68 between the space 66 and the inside of the passageway 69. Unlike a conventional bulking jet it is not necessary that the needle should be slidably mounted so that the effective area of the space 68 can be changed by relative axial movement of the needle, while retaining a constant, acute angle of contact between air and roving. As previously explained, the outlet passageway 69 is the critical factor.

In use, compressed air is applied to the passage 65. Continuous filament glass fiber roving was fed through the needle at about 600 m/minute using a range of outlet passageway diameters. The quality of the bulking achieved and the time it took to break the roving (on halting the supply) were observed and the results were as follows.

TABLE 1

| Outlet diameter (mm) | Tex | Pressure at jet (KN/M$^3$) | Air flow M$^3$/minute | Bulking quality | Cutting Time (seconds) |
|---|---|---|---|---|---|
| 4.5 | 2400 | 550 | 1.08 | excellent | 1.0 |
| 4.5 | 2400 | 515 | 0.99 | very good | 1.1 |
| 4.5 | 2400 | 470 | 0.89 | good | 1.4 |
| 4.5 | 2400 | 425 | 0.80 | fairly good | 1.7 |
| 4.5 | 2400 | 390 | 0.74 | fair | 2.3 |
| 4.5 | 4800 | All | All | nil | no cut |
| 4.5 | 4800 | 550 | 1.44 | good | 1.5 |
| 6.0 | 4800 | 515 | 1.33 | fair | 1.8 |
| 6.0 | 4800 | 480 | 1.25 | poor | 2.3 |
| 6.0 | 2400 | 345 | 1.1 | excellent | 1.0 |
| 8.0 | 4800 | 415 | 1.84 | excellent | 1.0 |

It was observed that cutting took place just prior to leaving the outlet, approximately 6 mm inside the passageway, thereby clearly confirming the severity of the forces developed. Tests on the roving entry passageway 67 were also carried out using both ordinary and spliced roving.

Inspection of the foregoing results confirms that optimum (minimum) cutting time and best bulking quality go together, both being primarily a function of air flow.

TABLE 2

| Tex | Passage diameter (mm) |
|---|---|
| 2400 | 2.5–3.0 |
| 4800 | 3.0–4.0 |

At the preferred length to diameter ratio of 16, diameters in the above ranges gave acceptable results.

It is to be noted that the 4800 tex roving referred to above was made up of two separate rovings of 2400 tex each, thereby indicating that jets according to this invention will successfully handle more than one roving and therefore have significantly greater throughputs than conventional jets.

It will be evident that the use of jets of the kind just described is extremely advantageous for the purpose of this invention, namely the filling of automotive silencer casings with glass fibers.

The operation of the apparatus thus far described relies on conventional walking beam conveyors to move and accurately position individual silencer casings through the stages of the process. FIGS. 10(*a*) through 10(*e*) show schematically how such a conveyor operates, using a diagrammatic side view elevation of the conveyor with a single silencer casing on it for purposes of illustration.

In these Figures only one pair of beams are shown although it will be appreciated that two simultaneously operable pairs are needed, one pair for each end of the casing and located at opposite sides of the machine. FIGS. 11 and 12 show this aspect rather more clearly than the side view of FIG. 10, where one pair of beams is inevitably concealed by the second pair directly in front of them. In FIGS. 10(*a*) through 10(*e*) a fixed beam 70 has three V-shaped notches 71, 72, 73 equally spaced apart along its length. (As shown, that is widthwise in the drawings). Close behind the fixed beam 70 there is a moving beam 74 with corresponding notches 75, 76, 77. To more easily distinguish the beams, the moving beam is indicated by dotted lines in all 5 figures. In the first FIG. 10(*a*) a silencer casing 1 is shown in the loading position. It is fed to this location (the notch 73) by rolling it in from a magazine of empty casings (not shown, but to the right of the drawing). A length of perforated tube 17 (see FIGS. 3, 4) lies loose in the casing. The moving beam 74 is raised to lift the casing from the notch 73, by engaging it in notch 77 until it clears notch 73. At this point the moving beam traverses left taking the casing with it until it is above notch 72 of the fixed beam 70. The moving beam is lowered to deposit the casing in notch 72. This corresponds to the casing centering position which will shortly be described with reference to FIGS. 11(*a*) through 11(*c*).

It will be understood that any casings already positioned in any notch to the left of notch 73 will also be picked up and displaced one notch to the left and that in the case of the end notch 71, the casing in it will be moved clear of the fixed beam 70. In fact the next downward movement of the moving beam is used to transfer such a casing to the next stage of the manufacturing process, details of which are not directly relevant to the instant invention.

During the centering process and whilst the casing is in fixed notch 72, the moving beam is returned to its starting position ready to pick up a new casing previously loaded into notch 73. After centering is completed, the moving beam is again raised relative to the fixed beam, picking up the casing, this time in its notch 76. When clear of notch 72, the moving beam traverses left one notch before being lowered to drop the casing into notch 71 of the fixed beam. This notch is aligned with the filling station shortly to be described with reference to FIGS. 12(*a*) through 12(*f*). During filling the moving beam 74 is again traversed to the right, back to its starting point.

It will be understood that by simple repetition of this raising, lowering and traversing action a succession of silencer casings can be precisely moved along through a series of process stages, and then forwarded to further treatment.

Referring now to FIGS. 11(*a*) through 11(*c*) the conveyor of FIGS. 10(*a*) through 10(*e*) serves to present a casing 1 containing a loose perforated tube 17 to a centering station. FIGS. 11(*a*) through 11(*c*) show the centering station partly in section looking from the right in FIGS. 10(*a*) through 10(*e*), along the axes of the walking beams 70, 74. In this case both pairs of beams are shown at 70, 74 and 70' and 74' respectively. They are located at opposite sides of the silencer filling machine. As shown it will be appreciated that the notches cannot be seen as such, although by referring to the FIGS. 10(*a*) through 10(*e*) it is clear that the casing 1 is always supported and located by one pair of V-shape notches, whether on the fixed or the moving beam, according to the stage of progress.

In FIG. 11(*a*) a right hand side plate 80 of the machine has a fixed stop 81 aligned centrally of the casing 1 and engageable with one end 82 of the perforated tube 17. It also has a casing location step 83 aligned to engage one end 84 of the casing 17. The left hand side of the machine has a side plate 85 with a fixed casing location stop 86. The plate 85 also has a perforated tube detector 87 comprising a sensor head 89 mounted on a rod 90, the rod being operably connected to a piston and cylinder device 91. This device is supported to the side plate 85.

As shown in FIG. 11(*a*) the casing 1 is off-center with respect to the walking beams and to the side plates 80 85. The loose perforated tube 17 is also off-center.

For purposes of illustration this is exaggerated. In practice, most casings and perforated tubes will be loaded onto the walking beam more or less correctly aligned centrally of the machine.

FIG. 11(*b*) shows the initial phase of centering. Both side plates 80, 85 form part of respective headstock units extending generally axially parallel to the walking beam conveyor. These headstock units are displaceable towards and away from the walking beams, by pneumatic piston and cylinder means not shown herein for reasons of clarity. In FIG. 11(*b*) the side plates have been displaced inwardly towards the walking beams so that the casing location stops 83, 86 engage with respective opposed ends of the casing 1, pushing it sideways along the supporting V-shaped notch (FIG. 10) until it is centered relative to the side plates and walking beams. Whilst held in this centered position in FIG. 11(*c*) the piston and cylinder device 91 is operated to urge the sensor head 89 via rod 90 against the end 92 of the perforated tube 17, thereby pushing the latter through the casing 1 until the opposite end 82 hits the fixed stop 81. The perforated tube is thereby centered precisely within the casing, which is itself centered between the side plates 80,85.

If for some reason the perforated tube is missing, for example through some malfunction, the sensor head 89 will not engage with it. As a result the sensor head will obviously overtravel. This can be used to operate a warning system so that the machine can be halted to correct the error.

It will be appreciated that if the silencer casing includes fixed partitions which also serve to locate and retain the perforated tube, it is not necessary to have centering means for the latter. In such case only the fixed casing stops 83, 86 would be needed.

With the casing and tube accurately centered, the walking beams can be used to lift them to the next fixed beam notch, the filling station.

The operation of this has already been generally described in relation to FIGS. 3 through 8 which show only one side of the machine. FIGS. 12(*a*) through 12(*f*) show both sides of the machine, so that the sequence of operations can be more readily understood.

Starting with FIG. 12(*a*), (in conjunction with FIG. 3) the casing 1 arrives between side plates 80,85. The latter support tubular spacer elements 13 each carrying a resilient marginal seal 14 around their open ends. Inside the tubular spacers 13 there are central supports 15 with shaped ends 18, the supports 15 having hollow centers, 19. Both sides of the machine are identical, but of opposite hand, of course, and in particular there are glass fiber filling stations with bulking/injection jets and yarn supplies at both sides, each exactly as shown in the left-hand side view of FIG. 5.

Taking FIG. 12(*a*) first, the casing 1 and perforated tube 17 are delivered by the walking beams 70, 74 and 70' 74' to the notch 71 of FIGS. 10(*a*)–10(*e*) using the sequential lift and traverse movements described in relation to those Figures. Located in line with notch 71 and midway between the walking beams, there is an electromagnet 95. As the casing is delivered to notch 71 the magnet is energised, to ensure that perforated tube 17 is actually lying in the bottom of the casing 1 in the correct attitude for the shaped ends 18 to enter into its opposed ends. In FIG. 12(*b*) the side plates 80,85 are shown traversing inwards, the shaped ends 18 having partway entered the ends of perforated tube 17 so as to lift it towards the center line of the casing 1. The electromagnet 95 remains energised until the plates 80,85 have advanced the tubular spacers 13 to the point where the casing is firmly engaged therewith, as shown in FIG. 12(*c*). In this position, both the casing and the perforated tube are fully located relative to one another and to the filling stations. As previously mentioned, there is a filling station at each side, identical to the one shown in FIGS. 5, 6, 7 and 8. Because of the difficulty of showing all features in one drawing FIGS. 12(*b*), 12(*c*) 12(*d*) and 12(*e*) show both stations, but FIGS. 12(*a*) and 12(*f*) omit the left hand station in favour of showing the exhaust through the aperture 39, from the inside of the perforated tube (through the passageways 19 in the supports 15 or 38 in FIG. 7.). Also shown in FIGS. 12(*a*) and 12(*f*) are press plates 52 operated by pneumatic means (not shown) through rods 53. Each filling station comprises a pair of jets 32 disposed either side of the central axis of casing 1 (as best seen in FIGS. 6 and 8).

FIG. 12(*d*) shows the start of filling from both ends of the casing, exactly as described with reference to FIGS. 5 through 8. Glass fiber rovings are delivered to the respective bulking jets by capstan (godet) wheels 103, 104. The latter are only shown in FIGS. 12(*a*) and 12(*b*) in the interest of clarity. However, a yarn stop 100 is shown in several of the figures. In FIG. 12(*a*) this yarn stop 100 is shown pressed against the yarn 34 at its point of entry to the jet 32. Yarn stop 100 is in fact a circular pad 101 mounted to the end of a rod 102 which can be moved towards and away from the thread guide 64 by a pneumatic cylinder (not shown, for reasons of clarity). Because yarn stop 100 traps the yarn against the thread guide 64 (FIG. 9) no yarn can be withdrawn from conventional fiber supply packages (not shown) via the capstan (godet) wheels 103 or 104. This is essential when there is no casing to be filled and when the side plates 80,85 are displaced away from the walking beams to allow the latter to function normally.

In FIG. 12(*d*) the casing is firmly held by the tubular spacers 13 and so the yarn stops can be withdrawn as shown, thereby permitting the jets to draw in yarn, to bulk it and then to project the bulked yarn into the casing. The filling operation proceeds as shown in FIGS. 5 and 12(*d*) until a predetermined amount of glass fiber has been delivered into the casing 1 from each end.

The amount may be controlled by timing the fill, by length measurements based on capstan rotation or by a combination of these. Having achieved a controlled fill, yarn stops 100 are operated to stop further entry of the glass fiber yarns 34. (FIG. 1 12(*e*). As previously explained, the airflow is left on and the yarn is cut by the latter when the stop engages the thread guide 64 jet entrance. This obviates the need for mechanical cutter and to re-thread the yarn, since there is enough of it left inside the jet passageway 69 to ensure a smooth start-up of the feed when next the stops 100 are removed from the thread guide.

Turning now to FIG. 12(*f*) the press plates 52 are operated by pushing them towards one another to press the bulky continuous filament glass fibers into the casing from the insides of the two tubular spacers 13. The air supply can be turned off at this stage ready for outward movements of the plates 80,85 followed by operation of the walking beams to move the now-filled casing to the next stage of processing and to present a fresh casing for filling, after centering it as described earlier.

We claim:

1. A process for filling an automotive muffler casing with glass fibers comprising the steps of:

(a) presenting oppositely directed open ends of an automotive muffler casing substantially simultaneously to glass fiber feeding stations, (b) temporarily locating one end of a tubular spacer element on each open end of the muffler casing to constitute an extension of said casing prior to filling, (c) filling the casing from both ends thereof with bulked glass fiber roving, and (d) pushing fibers from the spacer elements into the casing prior to removing the spacer elements to enable affixing closures to the ends of the casing.

2. The process of claim 1 including the further steps of:

feeding continuous filament glass fiber roving to each feeding station, and converting the roving to a relatively bulky form prior to filling the casing with it.

3. The process of claim 1 in which the roving is cut into staple form prior to bulking.

4. The process of claim 1 in which the roving remains in continuous filament form throughout the filling process.

5. The process of claim 1 including converting the roving to a relatively bulky form by passing it, together with an airstream, through a bulking jet comprising a roving entry passageway, an airstream entry passageway, means for distributing the airstream and a common outlet passageway for the airstream and the roving, by passing the roving and the airstream into the bulking jet and distributing the airstream evenly around the roving as an essentially annular sheath in a region of contact therebetween, the area of the annulus defining the sheath immediately prior to the region of contact defining a flow restriction which is significantly less than of the common outlet passageway.

6. The process of claim 1 in which the muffler casing contains an unsupported, perforated tube and the process includes the additional steps of at least temporarily locating the perforated tube axially and radially with respect to the casing at least until there is sufficient in-filled glass fibers material to do so.

7. An apparatus for filling an automotive muffler casing having two open ends with glass fibers comprising two glass fiber feeding stations, means for presenting oppositely directed open ends of the casing to said stations substantially simultaneously, a tubular spacer element associated with each feeding station together with means for presenting the spacer element to one open end of the casing so as to constitute an extension of the casing intermediate the casing and each feeding station, and pressure means operable to push any overflow of glass fibers from the spacer elements into the casing.

8. The apparatus of claim 7 further including at least one bulking means at each feeding station for bulking a continuous filament glass fiber roving prior to deposition in the casing as bulked continuous filaments.

9. The apparatus of claim 8, in which the bulking means is a bulking jet which comprises a roving entry passageway, an airstream entry passageway, a common outlet passageway, means for distributing an airstream evenly around the roving and the common outlet passageway, the airstream distributed evenly around the roving as an essentially annular sheath in the region of contact therebetween with the common outlet passageway for the airstream and the roving, the area of the annulus defining said sheath immediately prior to the region of contact defining a flow restriction which is significantly less than that due to the common outlet passageway.

10. The apparatus of claim 7 in which the outlet passageway of the bulking jet is parallel-sided and cylindrical, with a length to diameter ratio of from 5 to 10 and in which the roving entry passageway has a length to diameter ratio in the range from 10 to 20.

11. The apparatus of claim 7, further including a locating retaining means for temporarily locating an otherwise unsupported tube within and relative to the casing.

12. The apparatus of claim 11 in which the locating retaining means include a magnet.

* * * * *